US007418233B2

(12) United States Patent
Nishimura et al.

(10) Patent No.: US 7,418,233 B2
(45) Date of Patent: Aug. 26, 2008

(54) IMAGE FORMING APPARATUS

(75) Inventors: Yoshiteru Nishimura, Nagano-ken (JP); Toru Tanjo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 347 days.

(21) Appl. No.: 11/360,026

(22) Filed: Feb. 22, 2006

(65) Prior Publication Data

US 2006/0198678 A1 Sep. 7, 2006

(30) Foreign Application Priority Data

Feb. 22, 2005 (JP) ..... 2005-044918
Feb. 22, 2005 (JP) ..... 2005-044919
Feb. 22, 2005 (JP) ..... 2005-044921

(51) Int. Cl.
*G03G 15/00* (2006.01)

(52) U.S. Cl. ..... 399/381; 399/406

(58) Field of Classification Search ..... 399/406; 400/693; 347/108, 170, 222, 264
See application file for complete search history.

(56) References Cited

U.S. PATENT DOCUMENTS 5,153,663 A 10/1992 Bober et al.
5,543,903 A 8/1996 Fujita et al.
6,491,459 B2 * 12/2002 Hosomi ..... 400/613
6,775,516 B2 8/2004 Kouno
2003/0008817 A1 1/2003 Sander et al.
2003/0044208 A1 3/2003 Kouno
2006/0062620 A1 3/2006 Tanjo et al.

FOREIGN PATENT DOCUMENTS

EP 1288152 3/2003
EP 1288152 A2 3/2003
EP 1640812 A2 3/2006
JP 60-171963 9/1985
JP 04110973 A * 4/1992
JP 05-289564 11/1993

OTHER PUBLICATIONS

European Search Report for corresponding European application 06003596.1-2209 lists the references above.

* cited by examiner

*Primary Examiner*—Daniel J. Colilla
*Assistant Examiner*—Allister Primo
(74) *Attorney, Agent, or Firm*—Hogan & Hartson LLP

(57) ABSTRACT

A fuser allows a sheet medium on which a toner image has formed to path through while heating the sheet medium, thereby fusing the toner image on the sheet medium. A plurality of first rollers are arrayed in a first direction. A plurality of second rollers are arrayed in the first direction and respectively coming in contact with the first rollers with a first pressure. The second rollers are adapted to eject the sheet medium nipped between the first rollers and the second rollers to the outside of the apparatus in a second direction perpendicular to the first direction. A plurality of third rollers are arrayed in the first direction so that each of the third rollers is disposed between adjacent ones of the first rollers, the third roller adapted to be brought into contact with the sheet medium with a second pressure which is smaller than the first pressure.

1 Claim, 10 Drawing Sheets

IMAGE FORMING APPARATUS

BACKGROUND OF THE INVENTION

The present invention relates to an image forming apparatus capable of forming a toner image on a sheet-shaped recording medium (hereinafter referred to simply as "sheet medium") such as plain paper, thick paper, a postcard, an envelope, or an OHP sheet.

An image forming apparatus is known which is equipped with a fuser for fusing a toner image on a sheet medium by causing the sheet medium to which the toner image has been transferred to pass through the fuser while heating it and a sheet ejecting roller pair for ejecting the sheet medium from the apparatus.

In this type of image forming apparatus, a sheet medium tends to curl when it is heated in passing through the fuser. If the sheet medium is ejected as it is, it may be rounded at an ejecting section (e.g., sheet ejection tray). Or the leading end of a curled sheet medium may hit an already ejected sheet medium and push out the latter from the ejecting section (e.g., sheet medium ejection tray).

One conventional countermeasure against the above phenomenon is disclosed in Japanese Patent Publication No. 60-171963A. The sheet ejecting roller pair is formed by plural drive rollers that are spaced from each other and fixed to a drive shaft and follower rollers that are the same in number as the drive rollers and are brought into pressure contact with the drive rollers. Each roller of one of the two sets of rollers is provided with a large-diameter flange at both ends and a corresponding one the other set of rollers goes into the space between the flanges. As a result, a sheet medium being ejected is waved when viewed from the ejecting direction and thereby made stiffer (rollers for waving a sheet medium when viewed from its ejecting direction in this manner are called corrugation rollers). The sheet medium is thus prevented from being curled.

In the above apparatus, the sheet ejecting roller pair itself is given the function of waving a sheet medium; that is, the ejecting roller pair is configured so as to wave a sheet medium by its pressure contact force. Since the purpose of the sheet medium ejection pair is to eject a sheet medium, the pressure contact force of the rollers constituting the sheet ejecting roller pair needs to be strong enough to eject a sheet medium reliably irrespective of its type. This results in a problem that when a synthetic resin sheet medium is ejected after being heated by the fuser, the waved state may be permanent.

Japanese Patent Publication No. 5-289564A discloses an image forming apparatus in which a door cover is equipped with a roller pair which is disposed downstream of a fuser and transports a sheet medium coming from the fuser. With this configuration, the replacement of the fuser is facilitated and a sheet medium that is jammed in the fuser or a portion downstream thereof can be removed easily.

In this apparatus, the door cover is configured so as to be able to be opened and closed merely by a shaft. Therefore, the accuracy of positioning, with respect to the fuser, of the roller pair which is provided in the door cover tends to be low, which results in a problem that a sheet medium jam is prone to occur.

E-rings are known as stoppers to be attached to a shaft. Generally, the end face of a shaft to which the E-ring is attached is exposed. The exposed end face may be touched by a human hand, for example. Therefore, a state that the temperature of the shaft is high and its end face is exposed is not desirable. For example, the temperature of a shaft close to a fuser of an image forming apparatus becomes high and hence a state that its end face is exposed is not desirable.

SUMMARY OF THE INVENTION

It is therefore an object of the present invention to provide an image forming apparatus capable of ejecting a sheet medium without waving it even if it is made of a synthetic resin.

It is also an object of the present invention to provide an image forming apparatus capable of making a sheet medium jam less likely by increasing the accuracy of positioning, with respect to a fuser, of a roller pair that is provided in a door cover.

It is also an object of the present invention to provide an E-ring with a cover which does not expose the end face of a shaft.

In order to achieve at least one of the above objects, according to the invention, there is provided an image forming apparatus, comprising:

a fuser, allowing a sheet medium on which a toner image has formed to path through while heating the sheet medium, thereby fusing the toner image on the sheet medium;

a plurality of first rollers, arrayed in a first direction;

a plurality of second rollers, arrayed in the first direction and respectively coming in contact with the first rollers with a first pressure, the second rollers adapted to eject the sheet medium nipped between the first rollers and the second rollers to the outside of the apparatus in a second direction perpendicular to the first direction; and a plurality of third rollers, arrayed in the first direction so that each of the third rollers is disposed between adjacent ones of the first rollers, the third roller adapted to be brought into contact with the sheet medium with a second pressure which is smaller than the first pressure.

The second pressure is such an extent that a sheet medium made of synthetic resin is not waved when viewed from the second direction.

With this configuration, if the sheet medium is made of a synthetic resin, it can be ejected without being waved. As a result, the phenomenon can be prevented that a synthetic resin sheet medium that has been ejected after being heated by the fuser is set while remaining in a waved state.

On the other hand, if the sheet medium to be ejected is a relatively weak sheet medium such as plain paper, the third rollers are brought into pressure contact with the sheet medium and the sheet medium is thereby ejected in a waved state when viewed from the second direction.

The third rollers may be brought into contact with the sheet medium in a direction as same as a direction that the second rollers are coming in contact with the first rollers.

With this configuration, there does not occur a phenomenon that the pressure contact force exerted on the sheet medium by the third rollers weakens the pressure contact force exerted on the first rollers by the second rollers. This makes it possible to eject the sheet medium reliably without the need for setting the original pressure contact force exerted on the first rollers by the second rollers unduly strong.

The third rollers may be disposed an upstream side of the second rollers relative to the second direction.

If the third rollers were disposed downstream of the second rollers, a trailing end of a sheet medium being ejected by the first and second rollers might be caught on the third rollers and prevented from being ejected smoothly from the apparatus. Disposing the third rollers as described the above, such an accident can be avoided.

In order to achieve at least one of the above objects, according to the invention, there is also provided an image forming apparatus, comprising:

a fuser, allowing a sheet medium on which a toner image has formed to path through while heating the sheet medium, thereby fusing the toner image on the sheet medium;

a first door cover, pivotable about a first pivot center formed by slots extending in a first direction and a shaft fitted into the slots slidably in the first direction;

a plurality of rollers, provided on the first door cover and adapted to transport the sheet medium which has passed through the fuser;

a first engagement member, provided on the first door cover;

a second engagement member, provided on the fuser and adapted to engage with the first engagement member when the first door cover is closed;

a second door cover, pivotable about second pivot center and adapted to be coupled to the first door cover; and an urging member, provided on the second door cover and adapted to urge the first door cover in the first direction when the second door cover is coupled to the first door cover.

With this configuration, the engagement between the first and second engagement members can be secured, whereby the first door cover is positioned with respect to the fuser with high accuracy. As a result, the accuracy of the positioning of the rollers provided on the first door cover with respect to the fuser is increased, which makes a sheet jamming less likely.

In addition, since the urging member is provided in the second door cover, it is not necessary to provide an individual urging member on the first door cover.

In order to achieve at least one of the above objects, according to the invention, there is also provided an E-ring, adapted to be attached to an end portion of a shaft member, comprising:

an E-ring body, made of synthetic resin and adapted to be fitted with the shaft member; and a cover portion, made of synthetic resin and adapted to cover an end face of the shaft member when the E-ring body is fitted with the shaft member.

With this configuration, the end portion of the shaft is never touched by a human hand, for example. Being made of a synthetic resin, the E-ring is superior in heat insulation. Therefore, even if the temperature of the shaft member is made high, the temperature of the cover portion is kept low; no problems arise even if the cover portion is touched by a human hand, for example.

The E-ring body and the cover portion may be monolithic.

The shaft member may be a shaft of a roller adapted to be disposed in the vicinity of a fuser in an image forming apparatus to transport a sheet medium.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

An image forming apparatus according to one embodiment of the present invention will be hereinafter described with reference to the accompanying drawings.

Figure 1:
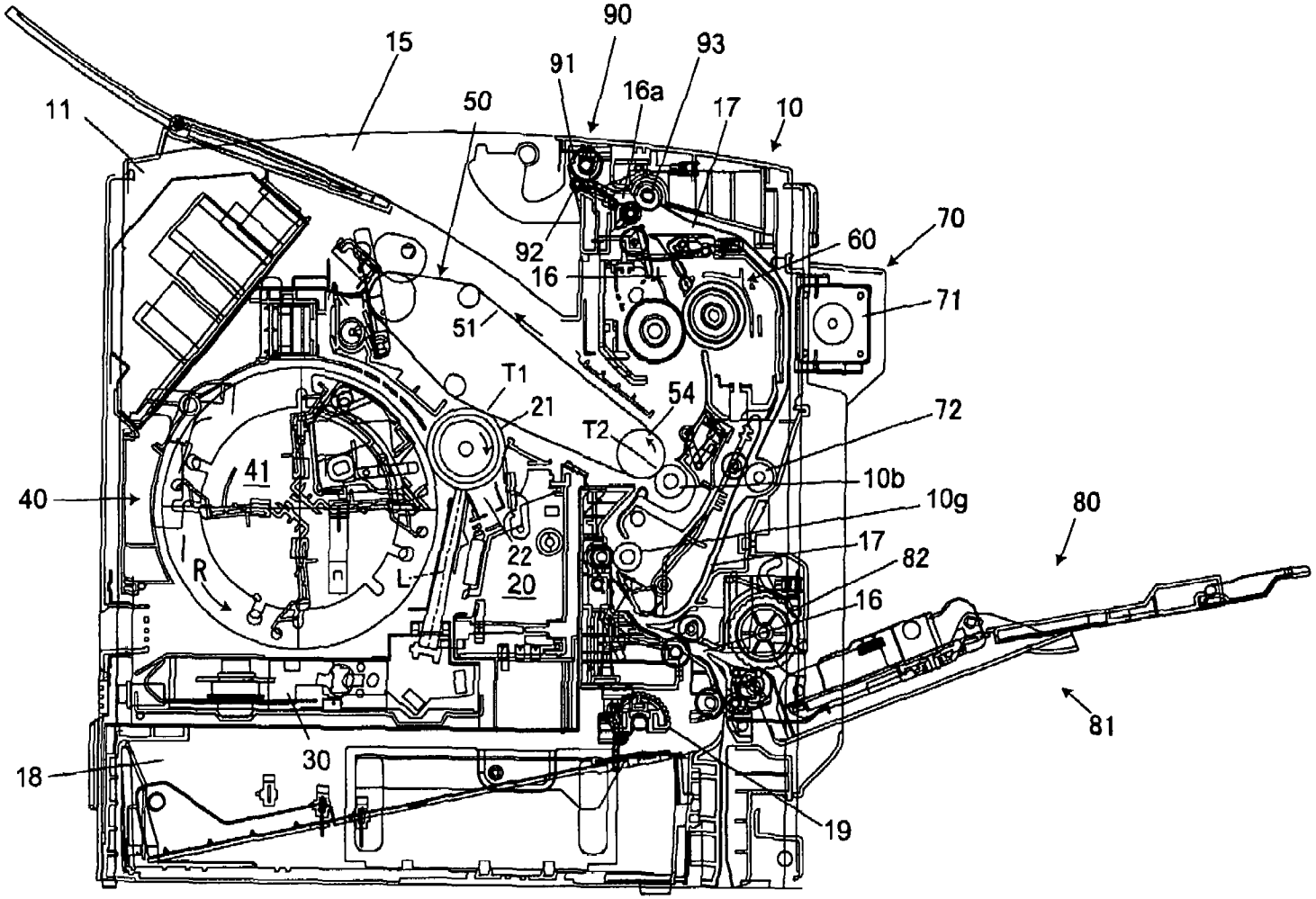
FIG. 1 is a section view of an image forming apparatus according to one embodiment of the invention.

As shown in FIG. 1, this image forming apparatus is a color image forming apparatus capable of forming a monochrome image or a full-color image on both surfaces of an A4-size sheet medium (including a letter-size sheet medium) by feeding it in its longitudinal direction. The image forming apparatus comprises a casing 11; an image carrier unit 20, an exposing unit 30 and a developing device 40 that are housed in the casing 11 and constitute an image forming section. The image forming apparatus further comprises an intermediate transfer unit 50 and a fusing unit (fuser) 60. The casing 11 is provided with a frame (not shown) of an apparatus main body 10 and the individual units etc. are attached to the frame.

The image carrier unit 20 has a photosensitive body 21 having a photosensitive layer to serve as its outer circumferential surface and a corona charger (scorotron charger) 22 for charging the outer circumferential surface of the photosensitive body 21 uniformly. An electrostatic latent image is formed by selectively exposing the outer circumferential surface of the photosensitive body 21 that has been charged uniformly by the corona charger 22 to laser light L coming from the exposing unit 30. A visible image (toner image) is formed by applying toner (developer) to the electrostatic latent image by the developing device 40. The toner image is transferred primarily to an intermediate transfer belt 51 of the intermediate transfer unit 50 at a primary transfer portion T1, and then transferred secondarily to a sheet medium at a secondary transfer portion T2.

A transporting path 16 for transporting the sheet medium on whose one surface the image has been formed at the secondary transfer portion T2 toward a sheet ejector (ejection tray) 15 located at the top of the casing 11 and a sheet returning path 17 for causing a switchback of the sheet medium (that has been transported toward the sheet ejector 15 along the transporting path 16) and returning it toward the secondary transfer portion T2 so that an image will also be formed on the other surface of the sheet medium are provided inside the casing 11.

Reference numeral 70 denotes a double-side printing unit which is configured so as to be able to be attached to and detached from the apparatus main body. The sheet returning path 17 is completed when the double-side printing unit 70 is attached.

Reference numeral 71 denotes a driving motor for returning a sheet medium, and reference numeral 72 denotes a sheet returning roller which is driven by the motor 71 via a driving mechanism (not shown) such as a timing belt.

A sheet feeding cassette 18 for holding plural sheet media in a stacked manner and a sheet feeding roller 19 for feeding sheet media one by one toward the secondary transfer portion T2 are disposed in a lower portion of the casing 11.

A multi-purpose tray 81 as a manual feeding section 80 is disposed under the double-side printing unit 70, and the apparatus main body is equipped with a sheet feeding roller 82 for feeding, one by one, sheet media that are set on the multi-purpose tray 81.

The developing device 40 is a rotary developing device. Toner cartridges (not shown) of the respective colors containing a yellow toner, a cyan toner, a magenta toner, and a black toner are attached to a rotary body 41 in a detachable manner. As the rotary body 41 is rotated in a direction indicated by arrow R with a pitch of 90°, development rollers (not shown) of the respective developing device cartridges are selectively brought into contact with the photosensitive body 21, whereby the surface of the photosensitive body 21 can be developed selectively.

The exposing unit 30 emits laser light L toward the photosensitive body 21.

The intermediate transfer unit 50 is equipped with a unit frame (not shown) and the intermediate transfer belt 51 which is stretched by a drive roller 54 and plural follower rollers and which is supported rotatably by the unit frame. The intermediate transfer belt 51 is driven so as to circulate in a direction indicated by an arrow in FIG. 1. The primary transfer portion T1 is formed at the contact position of the photosensitive body 21 and the intermediate transfer belt 51, and the secondary transfer portion T2 is formed at the pressure contact position of the drive roller 54 and a secondary transfer roller 10*b* which is provided on the main body side.

The secondary transfer roller 10*b* can come into contact with and be separated from the drive roller 54 (i.e., intermediate transfer belt 51). The secondary transfer portion T2 is formed when the secondary transfer roller 10*b* comes into contact with the drive roller 54.

Therefore, to form a color image, an image of one color is formed on the intermediate transfer belt 51 as it makes one rotation in a state that the secondary transfer roller 10*b* is separated from the intermediate transfer belt 51. Images of plural colors are formed on the intermediate transfer belt 51 in a superimposed manner as it rotates plural times, whereby a color image is formed on the intermediate transfer belt 51. Then, the secondary transfer roller 10*b* is brought into contact with the intermediate transfer belt 51 and a sheet medium is supplied to the contact position (secondary transfer portion T2), whereby the color image (toner image) is transferred from the intermediate transfer belt 51 to the sheet medium (secondary transfer).

The sheet medium to which the toner image has been transferred is heated as it passes through the fusing unit (fuser) 60, whereby the toner image is heated and fused. The sheet medium is ejected onto the ejection tray 15 by a sheet ejector 90.

Figure 2:
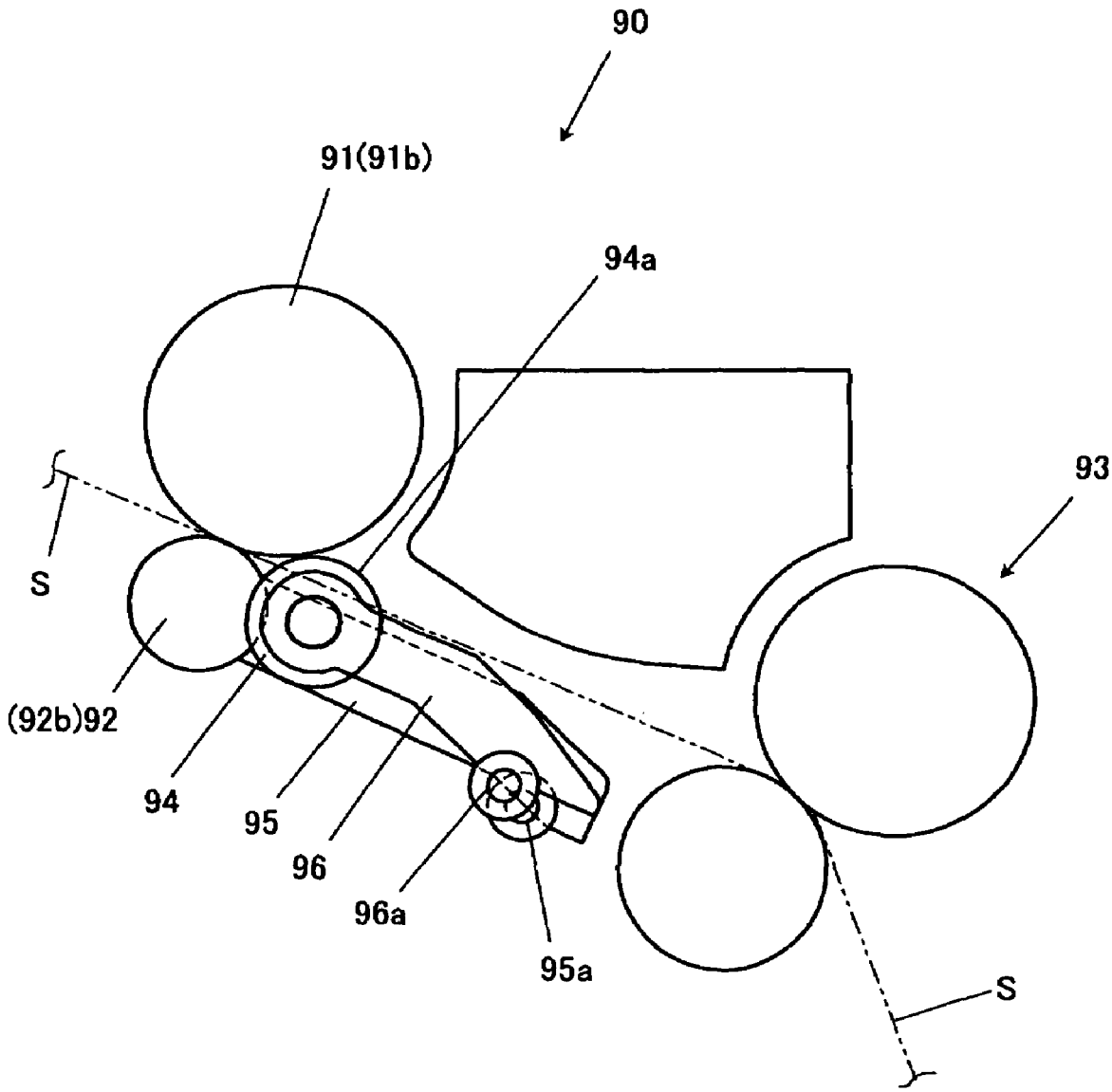
FIG. 2 is a schematic side view of a sheet ejector in the image forming apparatus.
Figure 3:
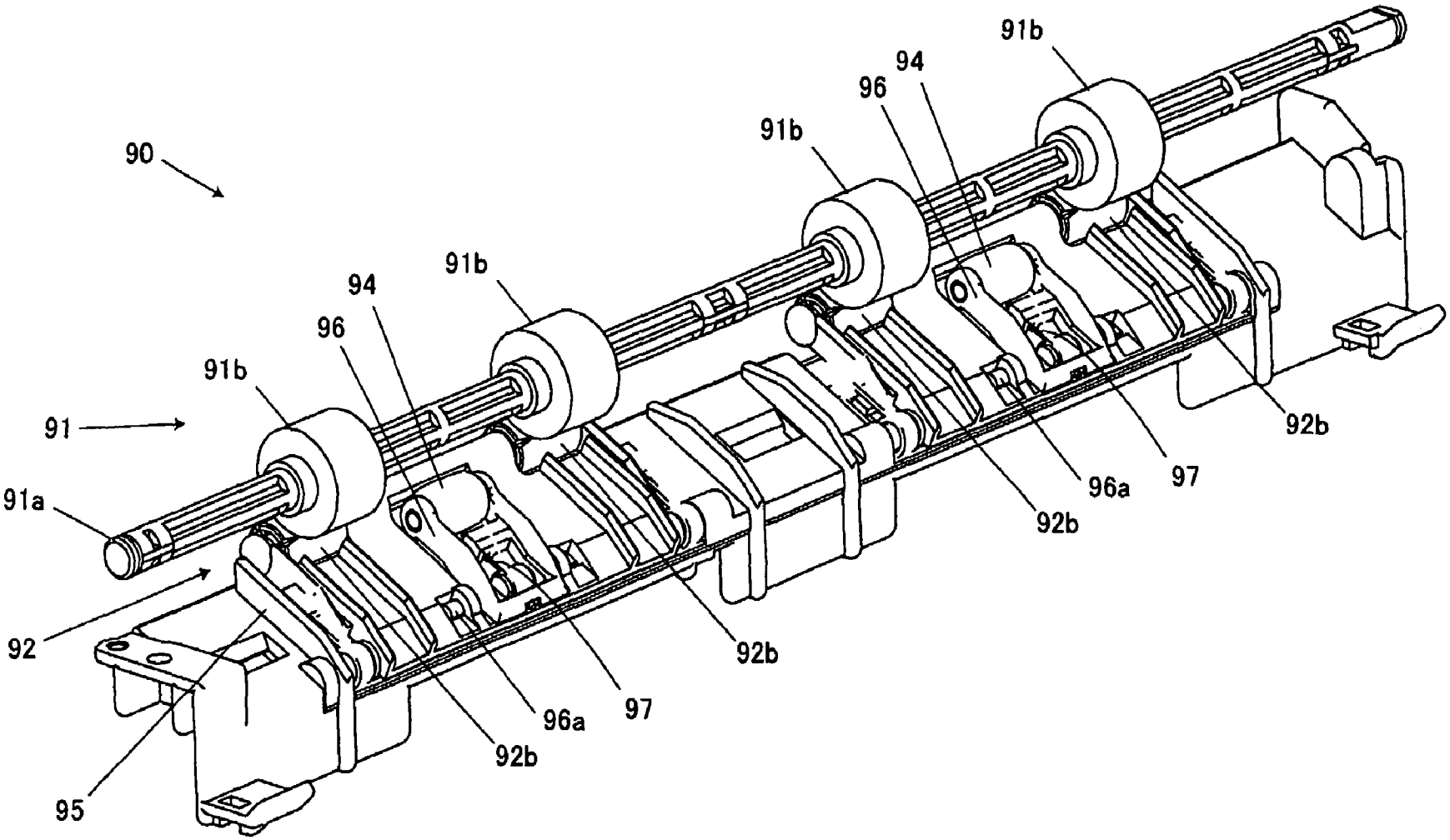
FIG. 3 is a perspective view of the sheet ejector.

As shown in FIGS. 2 and 3, the sheet ejector 90 of the image forming apparatus is equipped with a sheet ejecting roller pair 91, 92 for ejecting a sheet medium that has passed through the fuser 60 onto the ejection tray 15 (i.e., ejecting the sheet medium from the apparatus), a switchback roller pair 93 which is provided between the fuser 60 and the sheet ejecting roller pair 91, 92 and causes a switchback of a sheet medium that has passed through the fuser 60 and returns it the image forming section consisting of the photosensitive body 21 etc., and corrugation rollers 94.

The switchback roller pair 93 is disposed in a sheet ejecting path 16*a* which goes from the fuser 60 to the sheet ejecting roller pair 91, 92. A switchback of a sheet medium is done in such a manner that the sheet ejecting roller pair 91, 92 and the switchback roller pair 93 are rotated reversely immediately before the tail of the sheet medium passes through the nip portion of the switchback roller pair 93 and the sheet medium is thereby supplied to the sheet returning path 17.

The sheet medium that has been supplied to the sheet returning path 17 is transported by the return roller 72 and supplied to the secondary transfer portion T2 via a gate roller pair 10*g* which determines timing of supply of the sheet medium to the secondary transfer portion T2.

As shown in FIG. 3, the sheet ejecting roller pair 91, 92 has plural (in the illustrated example, four) drive rollers 91*b* which are spaced from each other and fixed to a drive shaft 91*a* and follower rollers 92*b* which are the same in number as the drive rollers 91*a* and are brought into pressure contact with the drive rollers 91*b*.

The corrugation rollers 94 are disposed between the drive rollers 91*b* in the axial direction of the drive shaft 91*a*, and are brought into pressure contact with a sheet medium (see FIG. 2) passing through the sheet ejecting roller pair 91, 92 with weaker pressure contact force than the pressure contact force exerted on the drive rollers 91*b* by the follower rollers 92*b*.

The drive shaft 91*a* is supported rotatably by a frame (not shown) and driven (rotated) by a driving mechanism (not shown).

As shown in FIGS. 2 and 3, the follower rollers 92*b* are supported rotatably by a sheet guide 95. The sheet guide 95 is pivotably supported on the frame by a support shaft 95*a*, and urged by an urging member (not shown) so that the follower rollers 92*b* come into pressure contact with the drive rollers 91*b*.

As shown in FIG. 3, each corrugation roller 94 is supported rotatably by an arm 96 which is generally bracket-shaped in a plan view. The arm 96 is pivotably supported by the sheet guide 95 via a support shaft 96*a*. An urging member (in this case, a torsion spring) 97 is disposed between the arm 96 and the sheet guide 95. In a free state, as shown in FIG. 2, part of an outer circumferential surface 94*a* of the corrugation roller 94 projects to the drive rollers 91*b* side past a traveling path (see an imaginary line S in FIG. 2) of the recording media.

Therefore, when the sheet medium is ejected by the sheet ejecting roller pair 91, 92, the corrugation rollers 94 are brought into pressure contact with the sheet medium and make follower rotations but the urging force (pressure contact force) of the urging members 97 is weaker than the pressure contact force exerted on the drive rollers 91*b* by the follower rollers 92*b*.

The pressure contact force exerted on the sheet medium by the corrugation rollers 94 is set so as to cause almost no bend in the sheet medium when viewed from its ejecting direction in the case where the sheet medium is made of a synthetic resin (e.g., an OHP sheet medium).

Therefore, where the recording medium is a relatively weak sheet medium such as plain paper and hence tends to curl, the corrugation rollers 94, which are located between the drive rollers 91*b*, operate so as to push the sheet medium toward the spaces between the drive rollers 91*b* and to deform the sheet medium so that it is waved when viewed from the ejecting direction and is thereby ejected after being made stiffer. On the other hand, where the recording medium is a sheet medium made of a synthetic resin, the corrugation rollers 94 operate so as to cause almost no bend in the sheet medium when viewed from its ejecting direction and to eject it in a generally flat state.

The direction in which the corrugation rollers 94 are brought into pressure contact with the sheet medium is the same as the direction in which the follower rollers 92*b* are brought into pressure contact with the driver rollers 91*b* (upward in FIG. 2).

The corrugation rollers 94 are disposed upstream of (in FIG. 2, on the right of) the follower rollers 92*b* relative to the ejecting direction of the sheet media.

Therefore, if the sheet medium is made of a synthetic resin, it can be ejected without being waved. As a result, the phenomenon can be prevented that a synthetic resin sheet medium that has been ejected after being heated by the fuser 60 is set while remaining in a waved state.

On the other hand, if the sheet medium to be ejected is a relatively weak sheet medium such as plain paper, the corrugation rollers 94, which are located between the drive rollers 91*b* in the axial direction of the drive shaft 91*a*, are brought into pressure contact with the sheet medium and the sheet medium is thereby ejected in a waved state when viewed from the ejecting direction.

The direction in which the corrugation rollers 94 are brought into pressure contact with the sheet medium is the same as the direction in which the follower rollers 92*b* are brought into pressure contact with the drive rollers 91*b*. This prevents a phenomenon that the pressure contact force exerted on the sheet medium by the corrugation rollers 94 weakens, via the recording medium, the pressure contact force exerted on the driver rollers 91*b* by the follower rollers 92*b*.

This makes it possible to eject the sheet medium reliably without the need for setting the original pressure contact force exerted on the driver rollers 91*b* by the follower rollers 92*b* unduly strong.

The corrugation rollers 94 are disposed upstream of the follower rollers 92*b* relative to the ejecting direction of the sheet medium. This prevents interference between the drive shaft 91*a* and the corrugation rollers 94. If the corrugation rollers 94 were disposed downstream of the follower rollers 92*b*, a trailing end of a recording medium being ejected by the sheet ejecting roller pair 91, 92 might be caught on the corrugation rollers 94 and prevented from being ejected smoothly from the apparatus (i.e., onto the ejection tray 15). Disposing the corrugation rollers 94 upstream of the follower rollers 92*b* relative to the ejecting direction of the sheet medium can prevent such an event.

Both of the sheet ejecting roller pair 91, 92 and the switchback roller pair 93 are provided in a door cover (In this embodiment, a top cover) 10*c*.

Figure 4A:
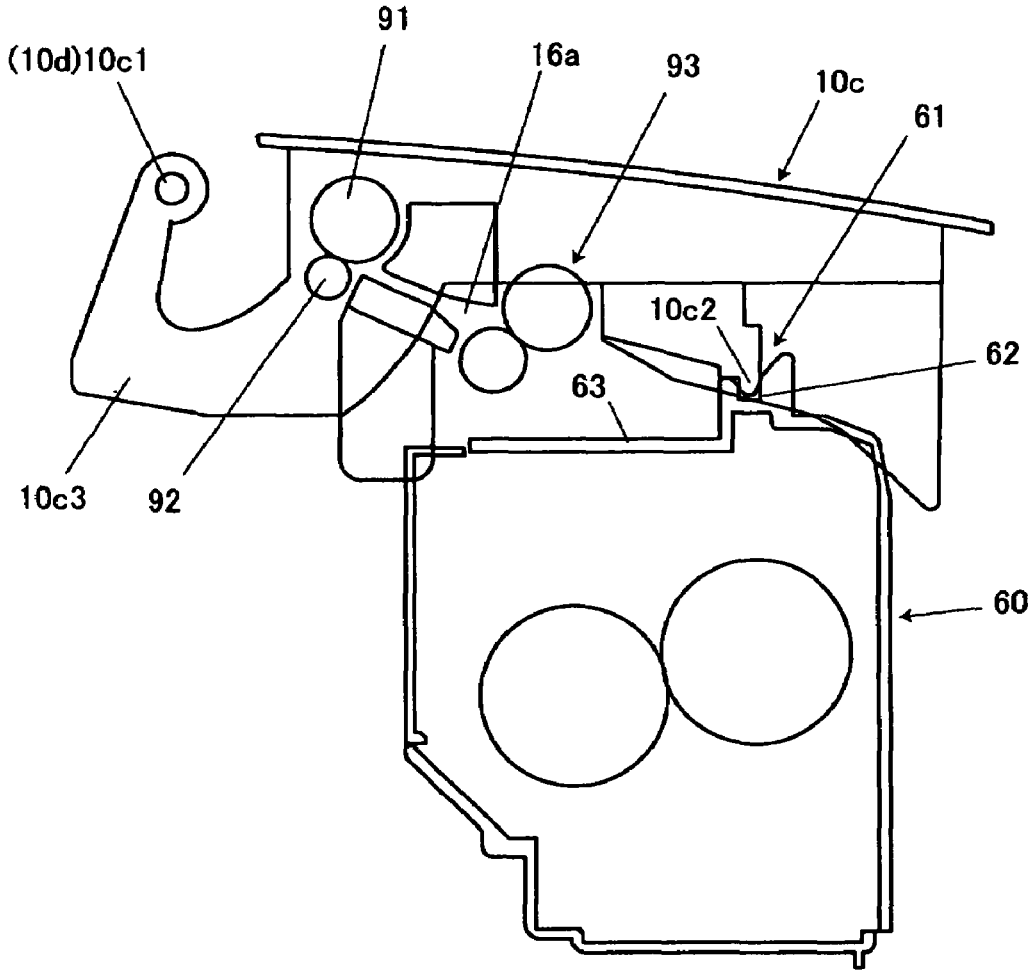
FIG. 4A is a schematic side view of a top cover and a fuser in the image forming apparatus.
Figure 5:
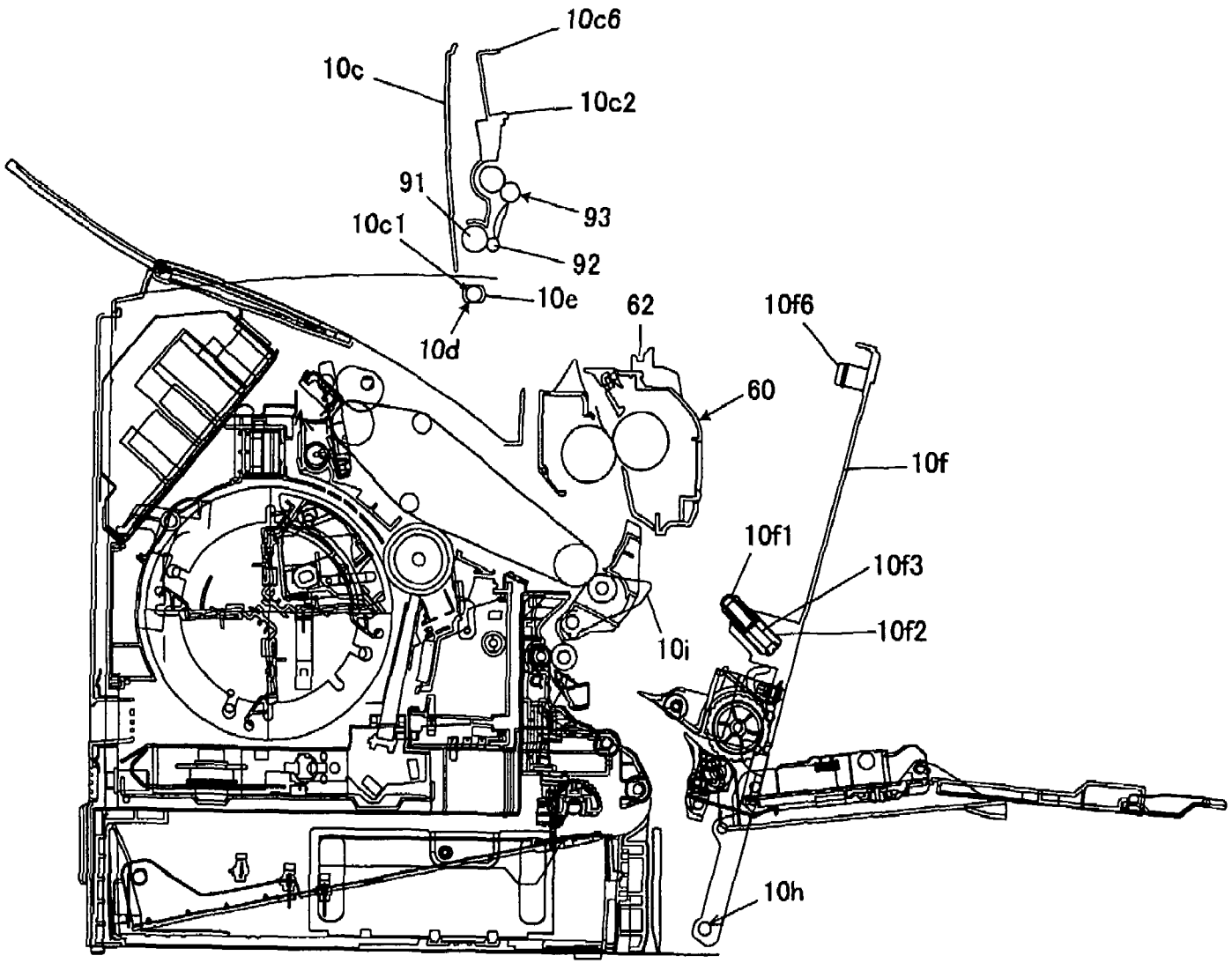
FIG. 5 is a section view of the image forming apparatus showing a state that the top cover and a side cover are opened.

As shown in FIGS. 4A and 5, the door cover 10*c* is configured so as to be pivotable about a pivot center 10*d*. Therefore, the accuracy of positioning of the sheet ejecting roller pair 91, 92 and the switchback roller pair 93 with respect to the fuser 60, in particular, the accuracy of positioning of the roller pair immediately downstream of the fuser 60 (in this case, the switchback roller pair 93) with respect to the fuser 60, is important. Particularly in this embodiment, since the roller pair immediately downstream of the fuser 60 is the switchback roller pair 93 for causing a switchback of a sheet medium with prescribed timing, the accuracy of positioning of the switchback roller pair 93 with respect to the fuser 60 is very important.

Figure 4B:
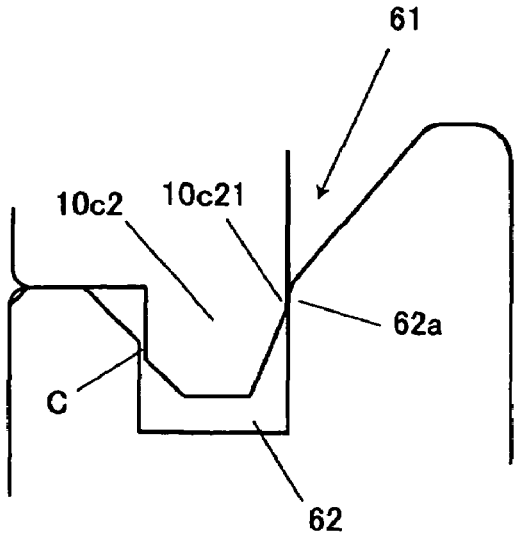
FIG. 4B is an enlarged side view of a positioning member of the top cover with respect to the fuser.
Figure 6:
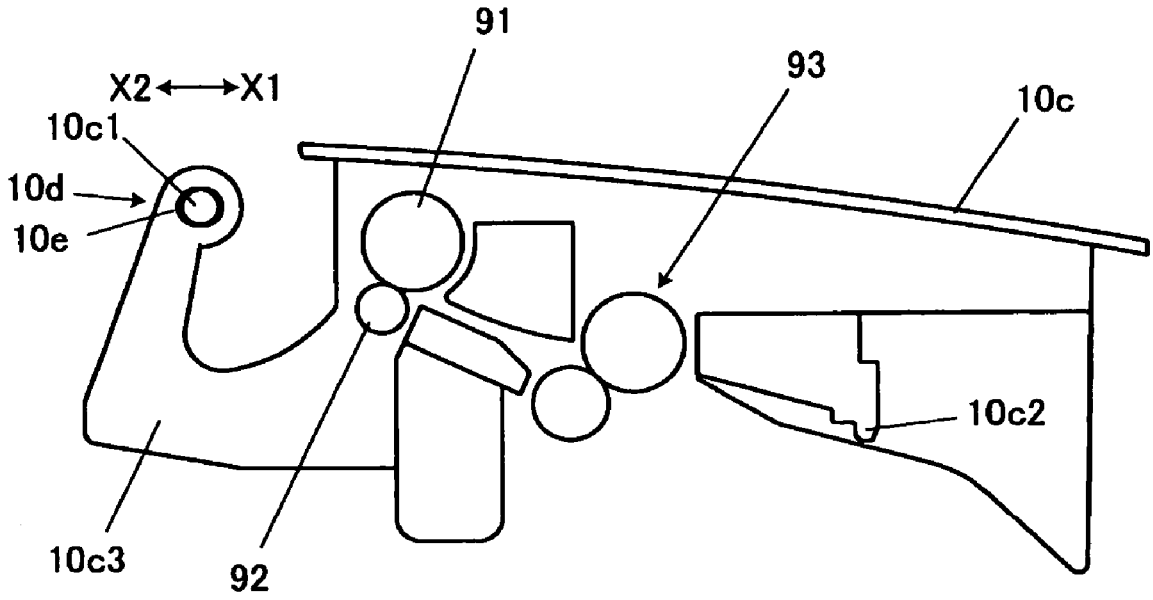
FIG. 6 is a schematic side view of the top cover provided with the sheet ejector.

In view of the above, in this embodiment, as shown in FIGS. 5 and 6, each pivot center 10*d* of the top cover 10*c* which is provided with the switchback roller pair 93 is formed by a shaft 10*c* and a slot 10*e* which is fitted with the shaft 10*c*1. As shown in FIGS. 4A and 4B, a positioning member 61 for positioning between the top cover 10*c* and the fuser 60 is formed by a projection 10*c*2 and a recess 62 to be fitted with the projection 10*c*2. The projection 10*c*2 and the recess 62 are provided in the top cover 10*c* and the fuser 60, respectively.

As described later in detail, an urging member for urging the top cover 10*c* in the longitudinal direction of the slots 10*e* is provided. The urging member is provided in another door cover (in this embodiment, a side cover 10*f* as shown in FIGS. 1 and 5) which is adapted to separately couple with the top cover 10*c*.

In this embodiment, each shaft 10*c*1 is integrated with an arm portion 10*c*3 (see FIG. 9) of the top cover 10*c* and the slots 10*e* are provided in the casing 11 of the image forming apparatus. Alternatively, the shafts 10*c*1 and the slots 10*e* may be provided in the casing 11 and the top cover 10*c*, respectively.

In either case, the top cover 10*c* is pivotable about the pivot centers 10*d* and is movable in the longitudinal direction (indicated by arrows X1 and X2 in FIG. 6) of the slots 10*e* within such a range that the shafts 10*c*1 are movable in the longitudinal direction.

Alternatively, the top cover 10*c* and the fuser 60 may be provided with a recess and a projection, respectively.

Figure 7:
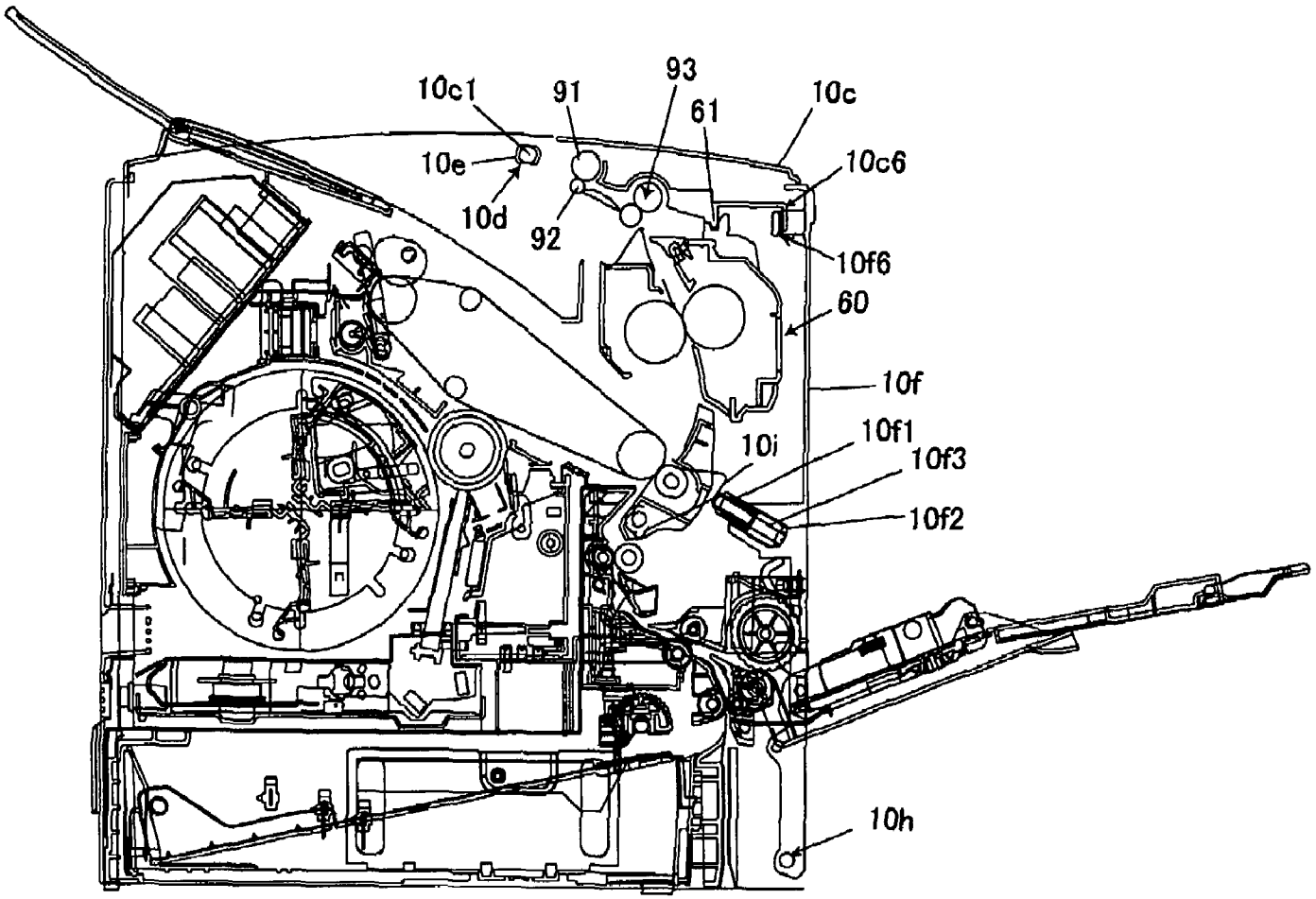
FIG. 7 is a section view of the image forming apparatus showing a state that the top cover and the side cover are closed.
Figure 8:
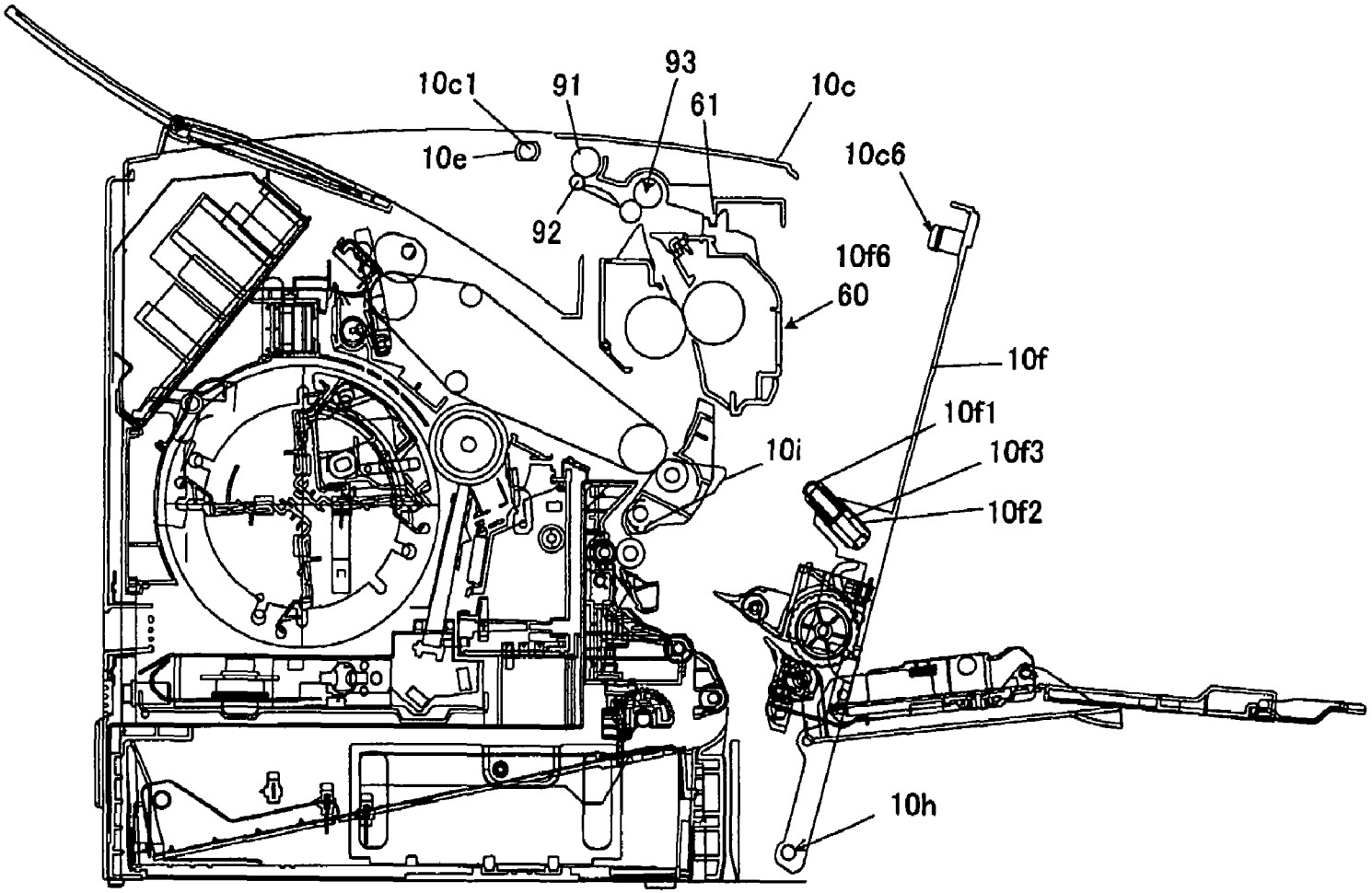
FIG. 8 is a section view of the image forming apparatus showing a state that the top cover is closed while the side cover is opened.

As shown in FIGS. 7 and 8, the side cover 10*f* is pivotably attached to the main body of the image forming apparatus with a shaft 10*h*.

The side cover 10*f* is provided with a slidable projection 10*f*1 at a middle position in the vertical direction. The slidable projection 10*f*1 is provided slidably in a cylinder 10*f*2, and a coil spring 10*f*3 for urging the slidable projection 10*f*1 inward of the apparatus body is accommodated in the cylinder 10*f*2. Therefore, the slidable projection 10*f*1 is always urged by the coil spring 10*f*3 but its projecting length is restricted by a stopper (not shown).

Figure 9:
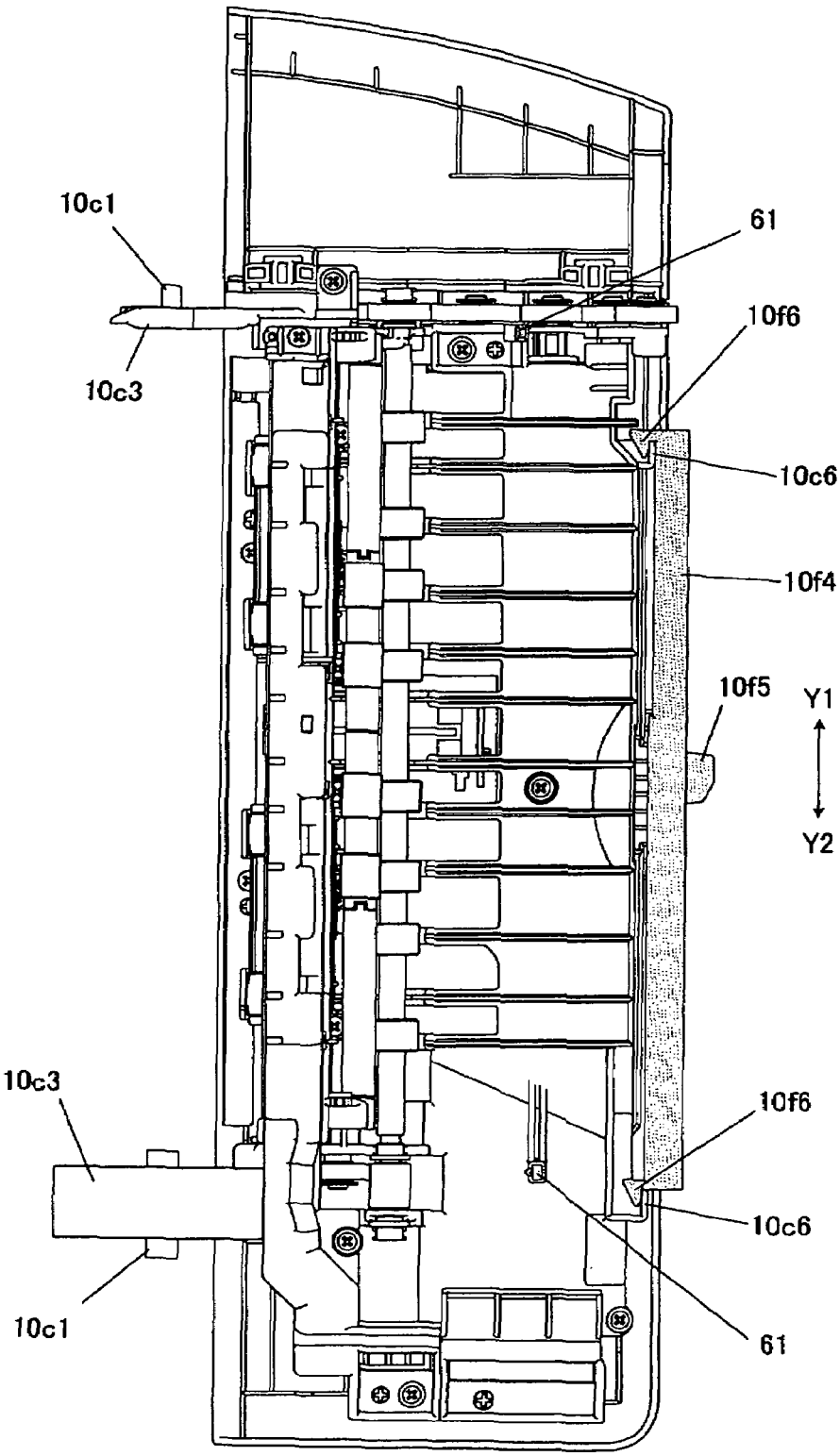
FIG. 9 is a top plan view of a coupling mechanism of the top cover and the side cover.

On the other hand, as shown in FIG. 9, the side cover 10*f* is provided with a slider 10*f*4 at a top position. The slider 10*f*4 can be slide-manipulated in a direction indicated by arrows Y1 and Y2 by holding its knob 10*f*5.

The slider 10*f*4 is formed with hooks 10*f*6 at both ends (top and bottom ends in FIG. 9).

The above-mentioned top cover 10*c* is provided with, at positions corresponding to the respective hooks 10*f*6, engagement portions 10*c*6 which is adapted to be separatably engaged with the respective hooks 10*f*6. The hooks 10*f*6 and the engagement portions 10*c*6 are disengaged from each other when the slider 10*f*4 is slid in the direction of arrow Y1, and are engaged with each other (and the side cover 10*f* and the door cover 10*c* are coupled to each other) when the slider 10*f*4 is slid in the direction of arrow Y2.

As shown in FIG. 7, the image forming apparatus is used in a state that the top cover 10*c* and the side cover 10*f* are closed and the hooks 10*f*6 of the slider 10*f*4 and the engagement portions 10*c*6 of the top cover 10*c* are engaged with each other.

In this state, the tip of the slidable projection 10*f*1 which is provided in the side cover 10*f* is in contact with a counter portion 10*i* of the image forming apparatus main body opposing the slidable projection 10*f*1, whereby the side cover 10*f* is urged in the opening direction. However, the opening of the side cover 10*f* is prohibited because the hooks 10*f*1 are engaged with the engagement portions 10*c*6 of the top cover 10*c*.

In other words, the top cover 10*c* is urged in the direction indicated by arrow X1 (i.e., in the longitudinal direction of the slots 10*e*) by the side cover 10*f*, that is, by the coil spring 10*f*3 (above-mentioned urging member), via the slidable projection 10*f*1.

As a result, as shown in FIG. 4B, the portions 10*c*21 and 62*a* (positioning members) opposed to each other of the above-mentioned projection 10*c*2 and recess 62 come into contact with each other reliably, whereby the door cover 10*c* is positioned with respect to the fuser 60 with high accuracy.

A slight gap C exists between the projection 10*c*2 and the recess 62, because without the gap C the top cover 10*c* could not be opened or closed smoothly.

When the slider 10*f*4 of the side cover 10*f* is slid in the direction of arrow Y1 and the hooks 10*f*6 are thereby disengaged from the engagement portions 10*c*6, the side cover 10*f* is opened as shown in FIG. 8 by the thrust of the slidable projection 10*f*1. As shown in FIG. 5, the top cover 10*c* can be opened from this state. The slidable projection 10*f*1 serves to open the side cover 10*f* automatically to some extent at the initial stage (see FIG. 8) when the slider 10*f*4 is slid in the direction of arrow Y1 and the hooks 10*f*6 are thereby disengaged from the engagement portions 10*c*6. The side cover 10*f* can further be opened thereafter manually.

With the above configuration, the door cover 10*c* is positioned with respect to the fuser 60 with high accuracy. As a result, the accuracy of the positioning of the roller pair 93 provided in the door cover 10*c* with respect to the fuser 60 is increased, which makes a sheet jamming less likely.

In addition, since the urging member is provided in the door cover 10*f*, it is not necessary to provide an individual urging member on the door cover 10*c*.

As shown in FIGS. 10A to 10E, an E-ring 110 in this embodiment comprises: an E-ring body 111 which is made of synthetic resin and attached to an end portion 101*a* of a shaft 101; and a cover portion 112 which is made of synthetic resin and integrated with the E-ring body 111. The cover portion 112 is adapted to cover an end face 101*b* of the shaft 101.

Figure 10A:
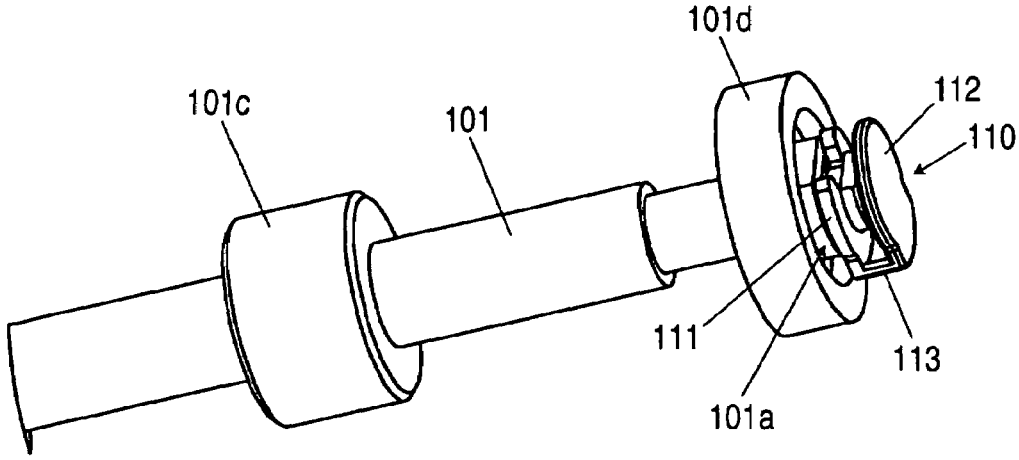
FIG. 10A is a perspective view of an end portion of a sheet transporting roller in the image forming apparatus.
Figure 10B:
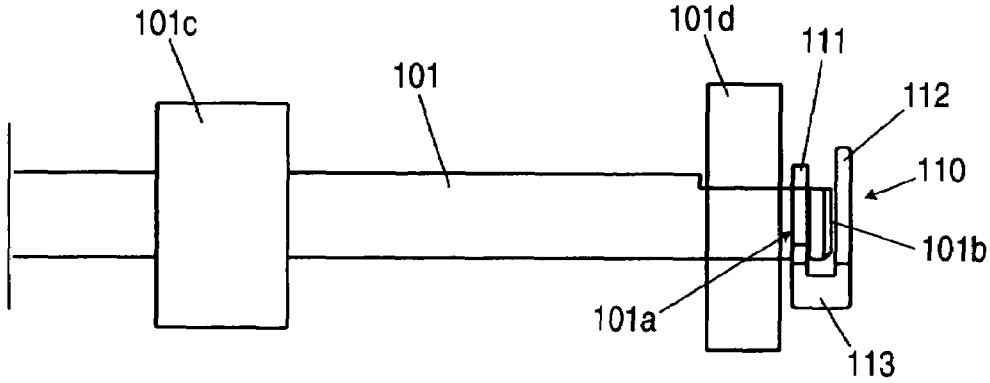
FIG. 10B is a side view of the end portion of the sheet transporting roller.
Figure 10C:
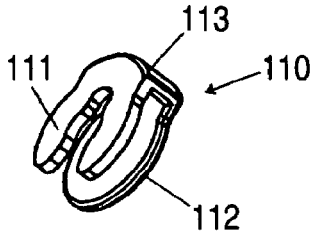
FIG. 10C is a perspective view of an E-ring attached to the end portion of the sheet transporting roller.
Figure 10D:
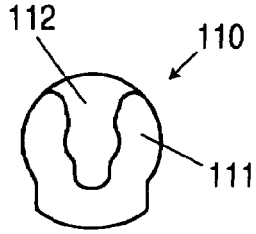
FIG. 10D is a front view of the E-ring.
Figure 10E:
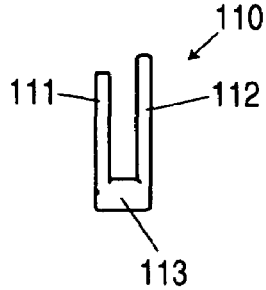
FIG. 10E is a side view of the E-ring.

The shaft 101 shown in FIGS. 10A and 10B is a metal shaft of a sheet transporting roller 101*c* that is disposed close to the fuser 60 (e.g., the switchback roller pair 93). The E-ring 110 serves as a stopper for fixing a gear 101*d* to the end portion 101*a*.

The E-ring 110 is a monolithic product made of a synthetic resin, and the E-ring body 111 and the cover portion 112 are connected to each other by a link portion 113.

To attach the E-ring 110 to the end portion 101*a* of the shaft 101, the E-ring body 111 is attached to the end portion 101*a* like an ordinary E-ring. In an attached state, the end face 101*b* of the shaft 101 is covered with the cover portion 112.

According to the E-ring 110, the end face 101*b* of the shaft 101 is covered with the cover portion 112 when the E-ring 110 is attached to the end portion 101*a* of the shaft 101. Therefore, the end face 101*b* of the shaft 101 is never touched by a human hand, for example.

Being made of a synthetic resin, the E-ring 110 is superior in heat insulation. Therefore, even if the temperature of the shaft 101 is made high, the temperature of the cover portion 112 is kept low; no problems arise even if the cover portion 112 is touched by a human hand, for example.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

a fuser, allowing a sheet medium on which a toner image has formed to path through while heating the sheet medium, thereby fusing the toner image on the sheet medium;

a first door cover, pivotable about a first pivot center formed by slots extending in a first direction and a shaft fitted into the slots slidably in the first direction;

a plurality of rollers, provided on the first door cover and adapted to transport the sheet medium which has passed through the fuser;

a first engagement member, provided on the first door cover;

a second engagement member, provided on the fuser and adapted to engage with the first engagement member when the first door cover is closed;

a second door cover, pivotable about second pivot center and adapted to be coupled to the first door cover; and an urging member, provided on the second door cover and adapted to urge the first door cover in the first direction when the second door cover is coupled to the first door cover.

* * * * *